US006182906B1

(12) United States Patent
Dupre

(10) Patent No.: US 6,182,906 B1
(45) Date of Patent: Feb. 6, 2001

(54) LIGHTWEIGHT SNOW MAKING TOWER

(76) Inventor: Herman K. Dupre, c/o Seven Springs, Champion, PA (US) 15622

( * ) Notice: Under 35 U.S.C. 154(b), the term of this patent shall be extended for 0 days.

(21) Appl. No.: 09/487,479

(22) Filed: Jan. 19, 2000

(51) Int. Cl.[7] ..... F25C 3/04
(52) U.S. Cl. ..... 239/14.2; 239/280
(58) Field of Search ..... 239/142, 22, 280, 239/280.5, 279

(56) References Cited

U.S. PATENT DOCUMENTS

| | | | | |
|---|---|---|---|---|
| 4,722,324 | | 2/1988 | Amen | 126/271.2 |
| 5,154,348 | * | 10/1992 | Ratnik et al. | 239/14.2 |
| 5,360,163 | | 11/1994 | Dupre | 239/14.2 |
| 5,667,137 | | 9/1997 | Dupre | 239/14.2 |
| 5,810,251 | * | 9/1998 | McKinney | 239/14.2 |
| 5,908,156 | | 6/1999 | Dupre | 239/14.2 |
| 6,016,970 | * | 1/2000 | Dupre | 239/14.2 |

* cited by examiner

*Primary Examiner*—Andres Kashnikow
*Assistant Examiner*—Dinh Q. Nguyen
(74) *Attorney, Agent, or Firm*—Carothers & Carothers

(57) ABSTRACT

A lightweight snow making tower having a substantially vertical support pole anchored in the ground and an aluminum support pipe coaxially received on the pole for axial rotation thereon. An elongated aluminum support arm C-channel having spaced upturned side flanges is pivotally secured intermediate its ends relative to the upper end of the support pipe. In turn, an elongated aluminum snow making tower pipe is clamped adjacent its lower end on the support arm C-channel with side portions of the tower pipe protruding into the channel between the side flanges. A removable lock locks the C-channel and support pipe from further relative rotation therebetween.

15 Claims, 6 Drawing Sheets

LIGHTWEIGHT SNOW MAKING TOWER

BACKGROUND OF THE INVENTION

This invention relates generally to the art of fluid sprinkling and more particularly to snow making towers for ski slopes.

The present invention pertains to improvements in snow making towers of the type disclosed in Dupre U.S. Pat. Nos. 4,199,103 and 5,360,163.

These patents disclose inventions that pertain to adjustable snow making towers which are comprised of a vertical support pole and a support arm pivotally connected to the support pole adjacent the upper end thereof for pivotally movement from vertical to horizontal. A snow making aluminum pipe tower is secured intermediate its end, but adjacent its lower end, to the support arm and is provided with snow making nozzle mechanisms at the upper end thereof. This pipe tower is supported from the support arm for elevating the nozzles above ground with either pivotal movement of the support arm toward vertical or with pivotal movement of the pipe tower itself toward vertical relative to the support arm. Remote air and water supplies are connected to the pipe water tower to provide water and air under pressure to the nozzle mechanisms at the upper end of the pipe tower for discharge into ambient atmosphere for manufacturing snow in subfreezing conditions.

A problem encountered with such adjustable prior art snow making towers is that the support mechanisms for the generally aluminum pipe tower are constructed of steel and the support mechanisms are therefore relatively heavy. Accordingly, when it is desired to remove the support mechanism from the vertical support pole that is anchored in the ground, it generally takes at least two men to lift the heavy structure off of the support pole. For example, the support mechanism for the tower itself might generally weigh approximately 120 pounds or more, without the aluminum pipe tower attached. However, to merely reconstruct the prior art snow making tower support systems of steel with aluminum would be expensive, unpractical, and complex.

It is therefore a principal object of the present invention to provide a versatile yet light weight and simple support mechanism for aluminum pipe snow making towers which can be readily constructed of aluminum and weigh considerably less than the steel support systems of the prior art.

SUMMARY OF THE INVENTION

The light weight snow making tower of the present invention includes the conventional substantially vertical support pole having a bottom end anchored in the ground or in a support surface. An aluminum support pipe is coaxially received on this support pole for axial rotation thereon.

In turn, an elongated aluminum support arm C-channel having spaced upturned side flanges is provided and is pivotally secured intermediate its ends relative to the upper end of the support pipe for rotation in a vertical plane. A typical elongated aluminum pipe snow making tower is then clamped intermediate its ends, and generally toward the lower end of the tower, to the support arm C-channel whereby side portions of this aluminum pipe tower protrude into the C-channel between its side flanges. A moveable lock is provided for locking the support arm C-channel from pivotal rotation relative to the support pipe at an angle of at least 45° above horizontal whereby the two are engaged together and the C-channel with its attached tower is prevented from pivoting about the pivot point provided at the upper end of the support pipe.

In one embodiment of the present invention the C-channel is pivotally secured directly to the upper end of the support pipe. In this embodiment the stop is comprised of a removable line, such as a chain, connected between the C-channel and the support pipe to fix the relative rotational position of the C-channel in relation to the support pipe.

In another embodiment of the lightweight snow making tower of the present invention, the tower includes an elongated support base secured to the upper end of the support pipe and the C-channel is pivotally secured to the upper end of this support base for providing the afore-described rotation in a vertical plane.

For aluminum pipe snow making towers which are other than round in cross sectional configuration, and for example are ovular in cross section, the support C-channel is provided with saddles therein that have contours for mating and seating surfaces of the side portions of the ovular tower which protrude into the C-channel.

Instead of permitting the support base to in turn be pivotally connected to the upper end of the support pipe, in this construction it is preferred, although not totally necessary, to simplify the construction by directly welding the elongated support base at a fixed angle to the aluminum support pipe. This configuration is particularly effective and simple in construction in situations wherein the aluminum pipe tower has an upper end portion containing the snow making nozzles which is substantially vertical. In this situation the basic angle of the underlying portions of the tower above horizontal is selected to be approximately 60°.

A hoist mechanism may be connected between a lower portion of the elongated C-channel and the support pole in order to pivotally raise and lower the aluminum C-channel together with the aluminum pipe tower clamped thereto.

A simplified version of the lightweight snow making tower of the present invention may be provided in accordance with the teachings of the present invention by eliminating the C-channel support arm in entirety.

In this configuration, an elongated aluminum support arm plate is secured directly to the upper end of the aluminum support pipe and positioned as before at an angle of at least 45° above horizontal with a face of the plate facing upwardly. Then, the elongated aluminum pipe snow making tower is clamped directly to the upper face of this plate, as by the use of conventional stainless steel U-bolts.

In fact, the support plate itself may be welded at a fixed angle to the top of the aluminum support pole as previously discussed in connection with the first embodiment for the elongated support base.

BRIEF DESCRIPTION OF THE DRAWINGS

Other objects and advantages appear in the following description and claims. The accompanying drawings show, for the purpose of exemplification, without limiting the invention or claims thereto, certain practical embodiments illustrating the principals of this invention wherein:

DETAILED DESCRIPTION OF PREFERRED EMBODIMENTS

Figures 1, 2:
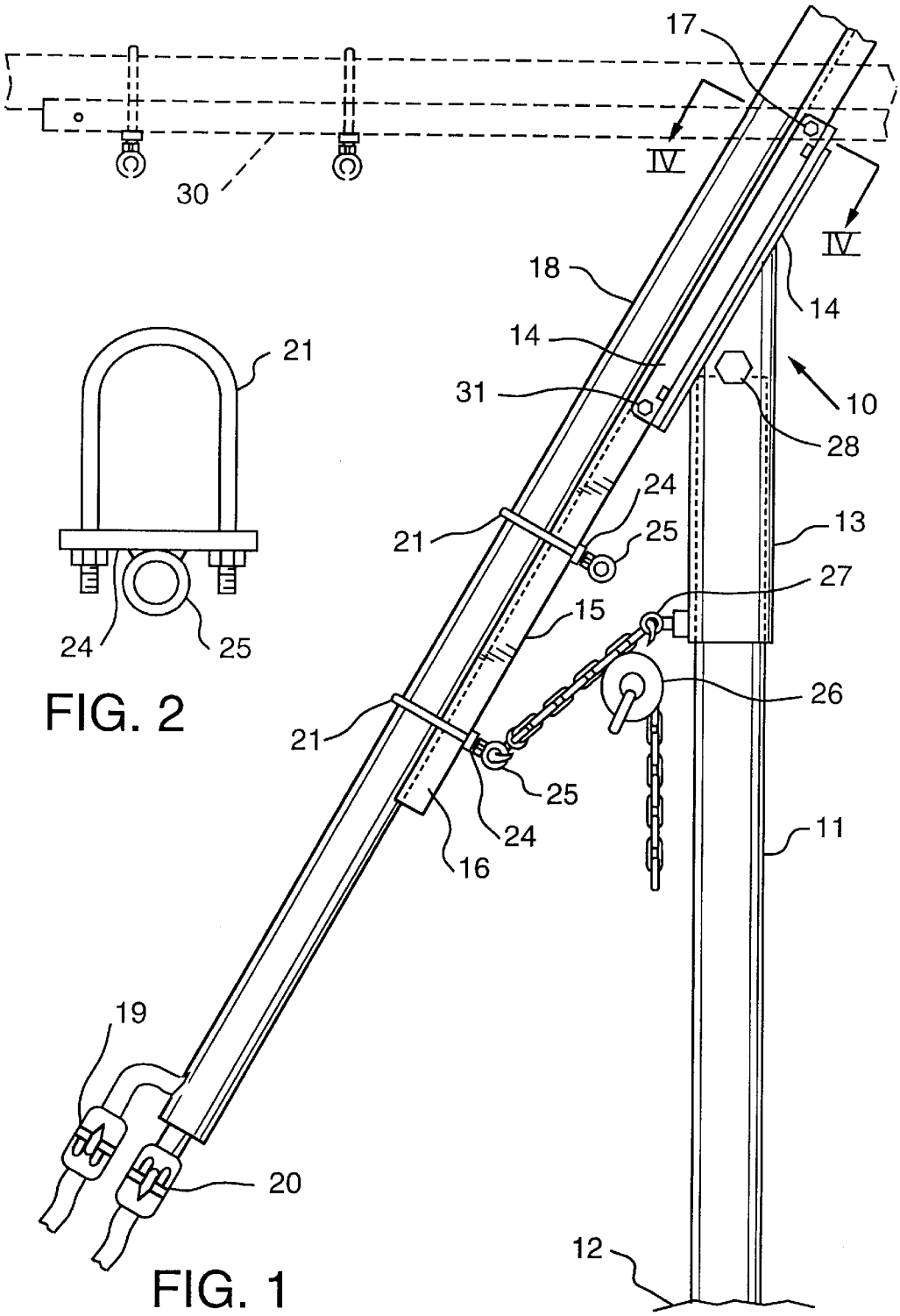
FIG. 1 is a view in side elevation of the lightweight snow making tower of the present invention with extremities removed in order to better feature the embodiments of the present invention.
FIG. 2 is an enlarged view in front elevation of one of the stainless steel U-bolts utilized as a clamp for the snow making tower shown in FIG. 1.
Figure 3:
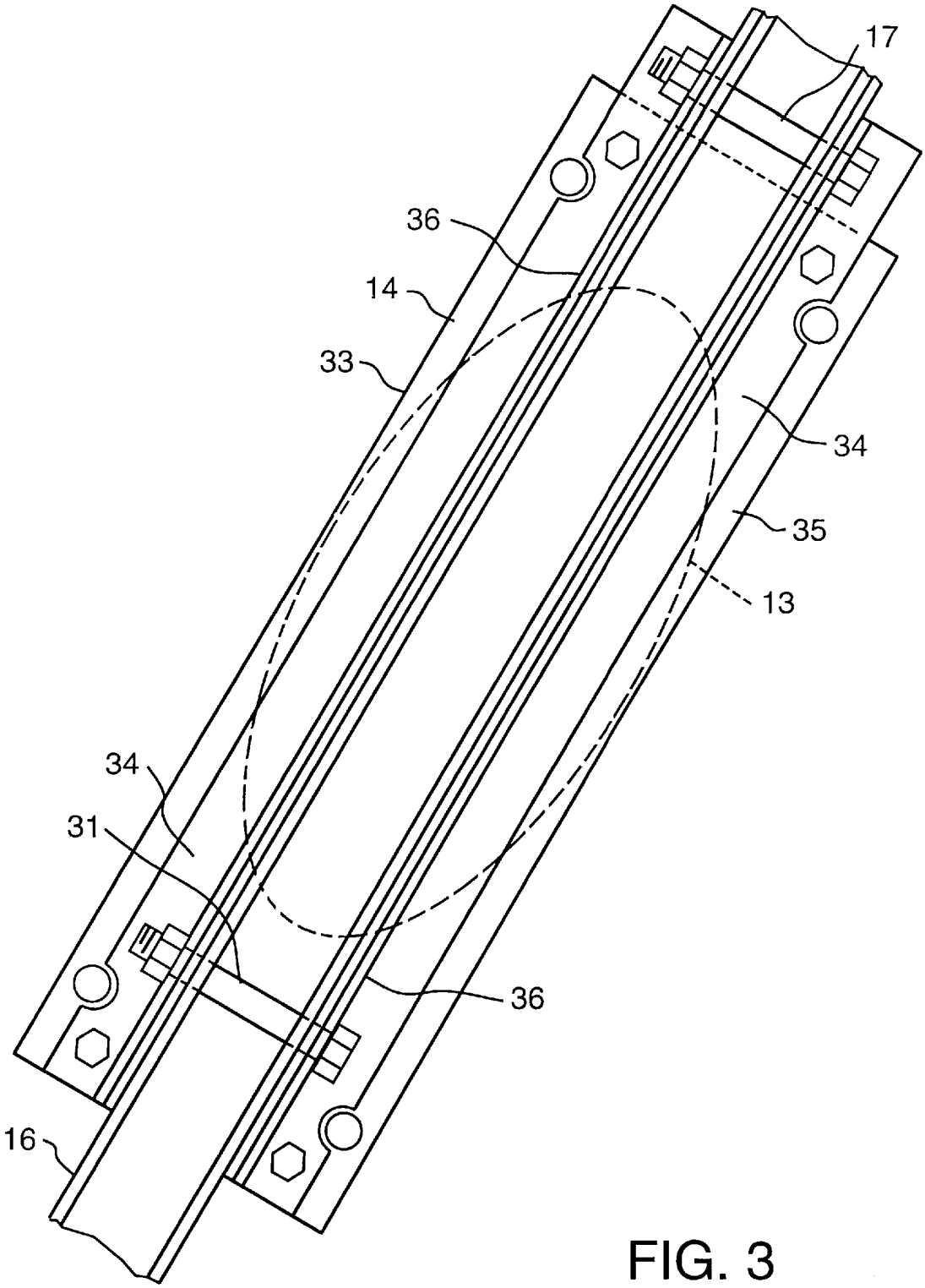
FIG. 3 is a top or plan view of the lightweight snow making tower illustrated in FIG. 1 with the aluminum snow tower pipe removed.

Referring to FIGS. 1 through 5, the lightweight snow making tower 10 of the present invention is comprised of a substantially vertical support pole 11 having its bottom end anchored into the ground surface 12. An aluminum support pipe 13 is coaxially received on the upper end of pole 11 for axially rotation thereon.

An elongated aluminum support base 14 is secured to the upper end of pipe 13 by welding and is positioned with respect to its long dimension at an angle of at least 45° above horizontal. In fact, in this configuration it is angled at approximately 60° from horizontal.

While this aluminum support base 14 could be adjustably pivoted to the top of support pipe 13 as is illustrated in the prior art, it is preferred that it be welded in fixed position as shown for economics and simplification.

An elongated aluminum support arm C-channel 15 having spaced upturned side flanges 16 is pivotally secure intermediate its opposite ends to the upper end of support base 14 at pivot pin 17.

Elongated aluminum snow making tower pipe 18 is provided with snow making nozzles (not shown) at its upper end in the same fashion as shown in the aforementioned prior art references. In addition, water and air supply connections 19 and 20 are respectively provided at the lower end of tower pipe 18 for connection to sources of water and air under pressure.

Figure 4:
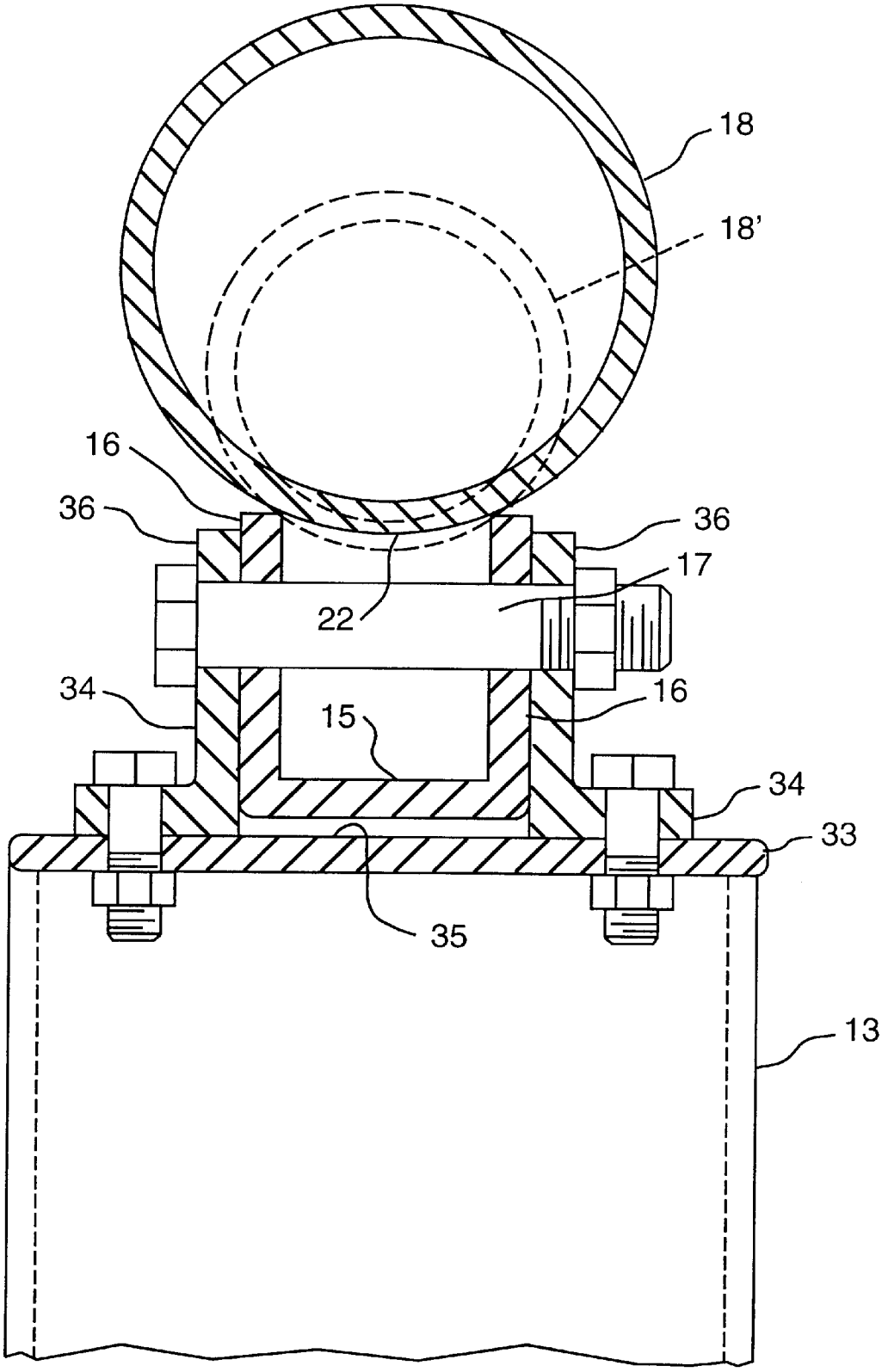
FIG. 4 is an enlarged sectional view of the lightweight snow making tower shown in FIG. 1 as seen along section line IV—IV.
Figure 5:
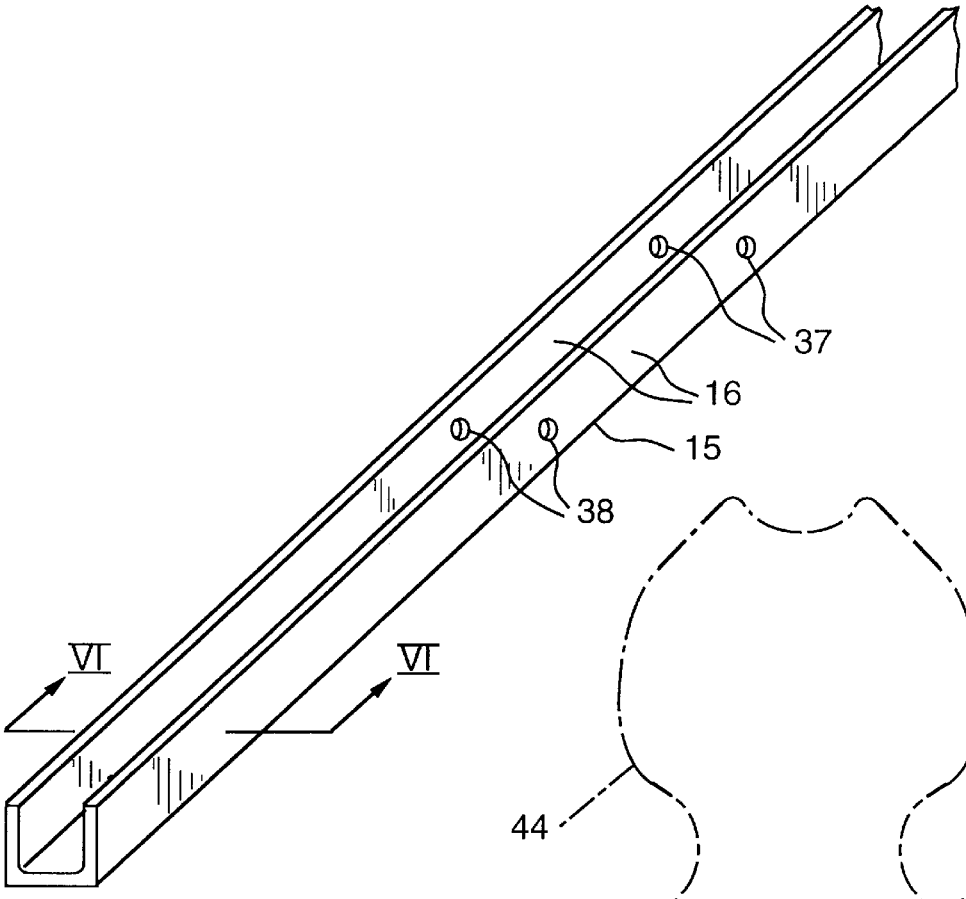
FIG. 5 is an isometric oblique view showing the support arm C-channel portion of the lightweight snow making tower structure of FIG. 1 alone.

The tower pipe 18 is clamped intermediate its ends and at the bottom portion of the tower pipe 18, to support arm C-channel 15 by the use of stainless steel U-bolts 21. Side portions 22 of tower pipe 18 protrude into C-channel 15 between side flanges 16 as is best illustrated in FIG. 4. Each of the stainless steel clamps 21 is provided with a base clamp bracket 24 that is further provided with a ring chain hold 25 for securement to a chain or other retaining device. For example as noted in FIG. 1, a chain hoist 26 is provided between the lower chain hold ring 25 and the eye bolt 27 to assist in raising and lowering the combination C-channel 15 and tower pipe 18.

Eye bolt 27 is threadably received in the bottom end of aluminum support pipe 13 and further penetrates the pipe 13 so that it may additionally be utilized as a stop mechanism to prevent further axial rotation of pipe 13 on pole 11 when the desired rotational position has been attained. Aluminum support pipe 13 is permitted to axially rotate on top of ground support pole 11 by reason of the stainless steel stop bolt 28 which passes all the way through pipe 13 and rests on the top end of pole 11 for rotation thereon.

Accordingly, C-channel 15 together with aluminum tower pipe 18 which is clamped thereto may be pivoted in a vertical plane about pivot pin 17 as illustrated in FIG. 1 whereby they may be pivoted to the horizontal dashed position shown at 30 or even further for repair or replacement of the snow nozzles at the upper end of the tower pipe 18. When the combination tower pipe 18 and support arm C-channel 15 are pulled all the way down in engaged alignment with aluminum support base 14, they are locked together from further pivotal rotation about pivot pin 17 by removable lock 31 in the form of a pin.

The elongated support base 14 is in turn comprised of an elongated support arm plate 33 welded to the upper end of support pipe 13 and elongated spaced aluminum angles 34 which are secured in parallel to each other as illustrated to the upper surface 35 of plate 33 with the C-channel 15 positioned in parallel between the angles 34 and pivotally secured at pivot pin 17 to and between respective parallel upwardly projecting side flanges 36 of angles 34. Forward pin 17 passes through aligned passages 37 of side flanges 16 of C-channel 15. Similarly, locking pin 31 passes through aligned passages 38 in the side flanges 16 of C-channel 15.

With particular reference to FIG. 4, it is illustrated how aluminum tower pipes 18 and 18' of different diameters will readily seat on channel 15 with portions 22 thereof protruding downwardly between side flanges 16.

Figure 6:
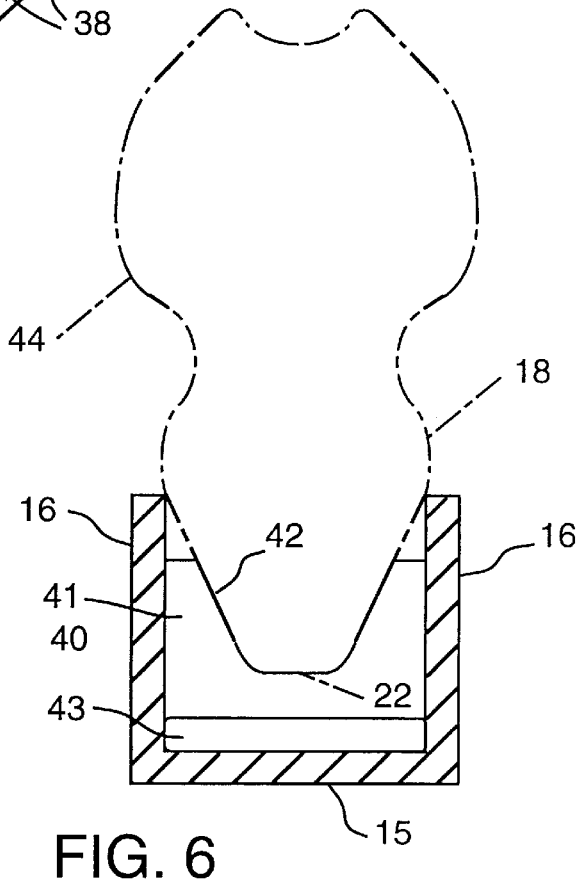
FIG. 6 is an enlarged view in cross section of the C-channel shown in FIG. 5 as seen along section line VI—VI and with the inclusion of saddles for seating an aluminum tower pipe of ovular configuration.
Figure 7:
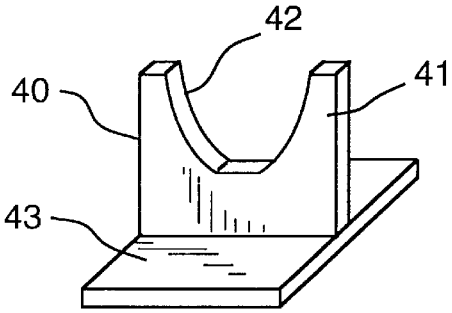
FIG. 7 is a perspective view of the saddle insert portion of the structure illustrated in FIG. 6.

Referring next to FIGS. 6 and 7, the outline cross section of an odd shaped ovular tower 18 is illustrated by the chain outline 44.

For such uncommon and different designs, two or more saddles 40 are provided within C-channel 15. Saddles 40 are basically inverted T-shaped members with upright webs 41 having cutout saddle seats 42 shaped for mating and seating surfaces 22 of the side portions of tower 18 which protrude into the C-channel between flanges 16. This upright flange portion 41 is supported by base 43.

Figure 9:
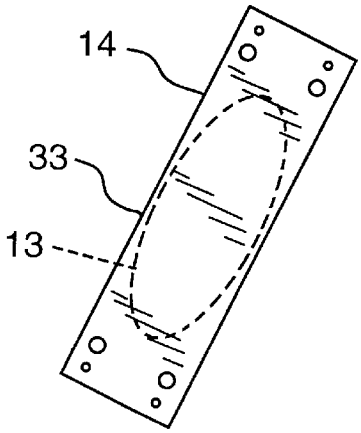
FIG. 9 is a top plan view of the support structure shown in FIG. 8 with the aluminum snow making tower pipe and clamping bolts removed.
Figure 8:
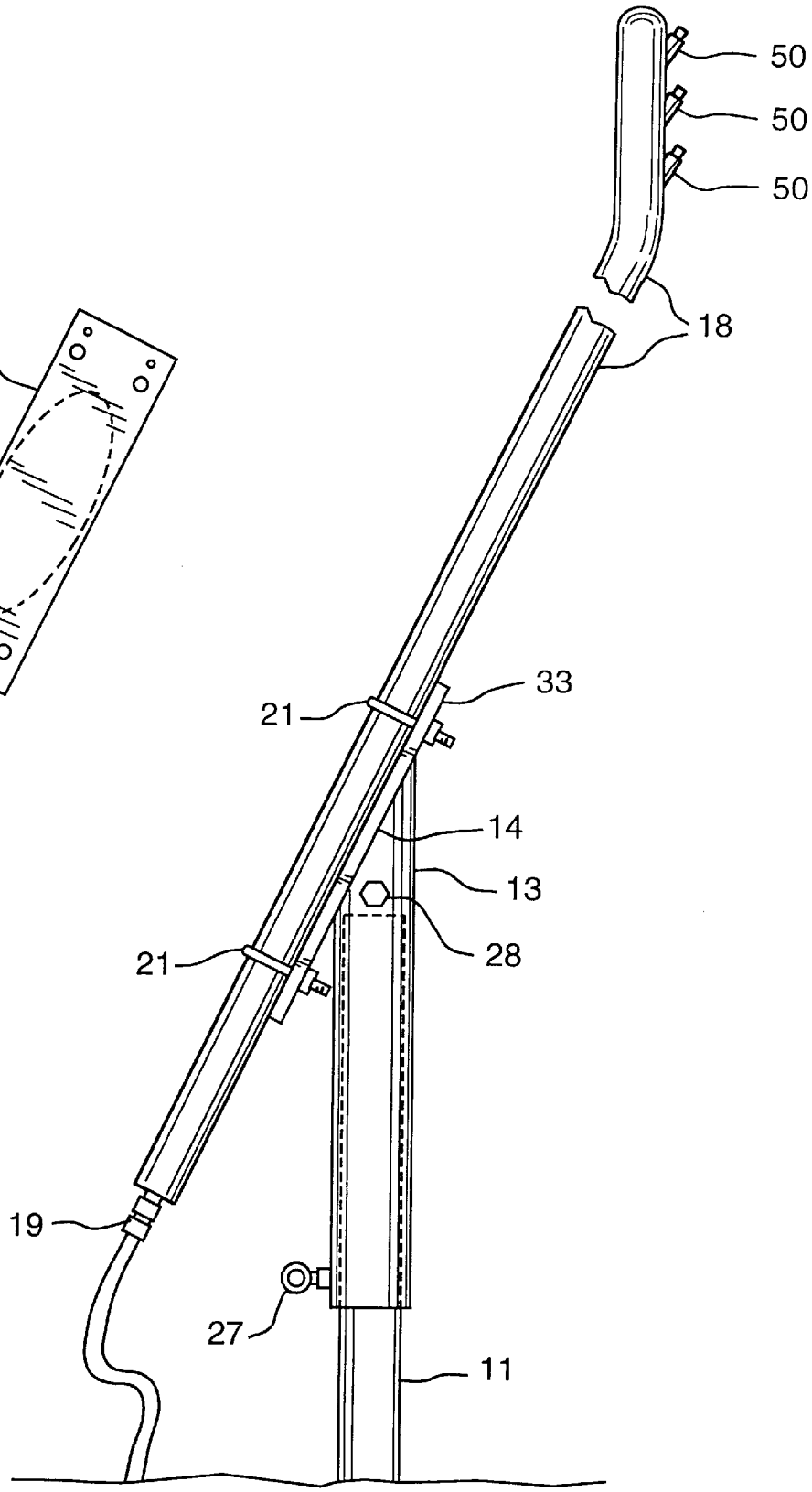
FIG. 8 is a view in side elevation of another simplified embodiment of the lightweight snow making tower of the present invention.

Referring next to FIGS. 8 and 9, a simplified variation of the lightweight snow making tower of the previous embodiment is illustrated and identical parts are indicated with the same reference numerals.

In this embodiment, the lightweight snow making tower pipe 18 is provided with water spray nozzles 50 only at its upper end which is vertical relative to the remainder underlying portions. This tower pipe 18 is provided only with a water supply, no air supply, and can manufacture snow only in very cold subfreezing conditions. It can also be used for making ice surfaces for skating. The main difference in this embodiment is that the structure is greatly simplified by complete removal of the C-channel 15 and the further removal of angles 34 from base plate 33 for support base plate 14. In this embodiment the adjustability for pivoting the tower pipe 18 is not required.

Figure 10:
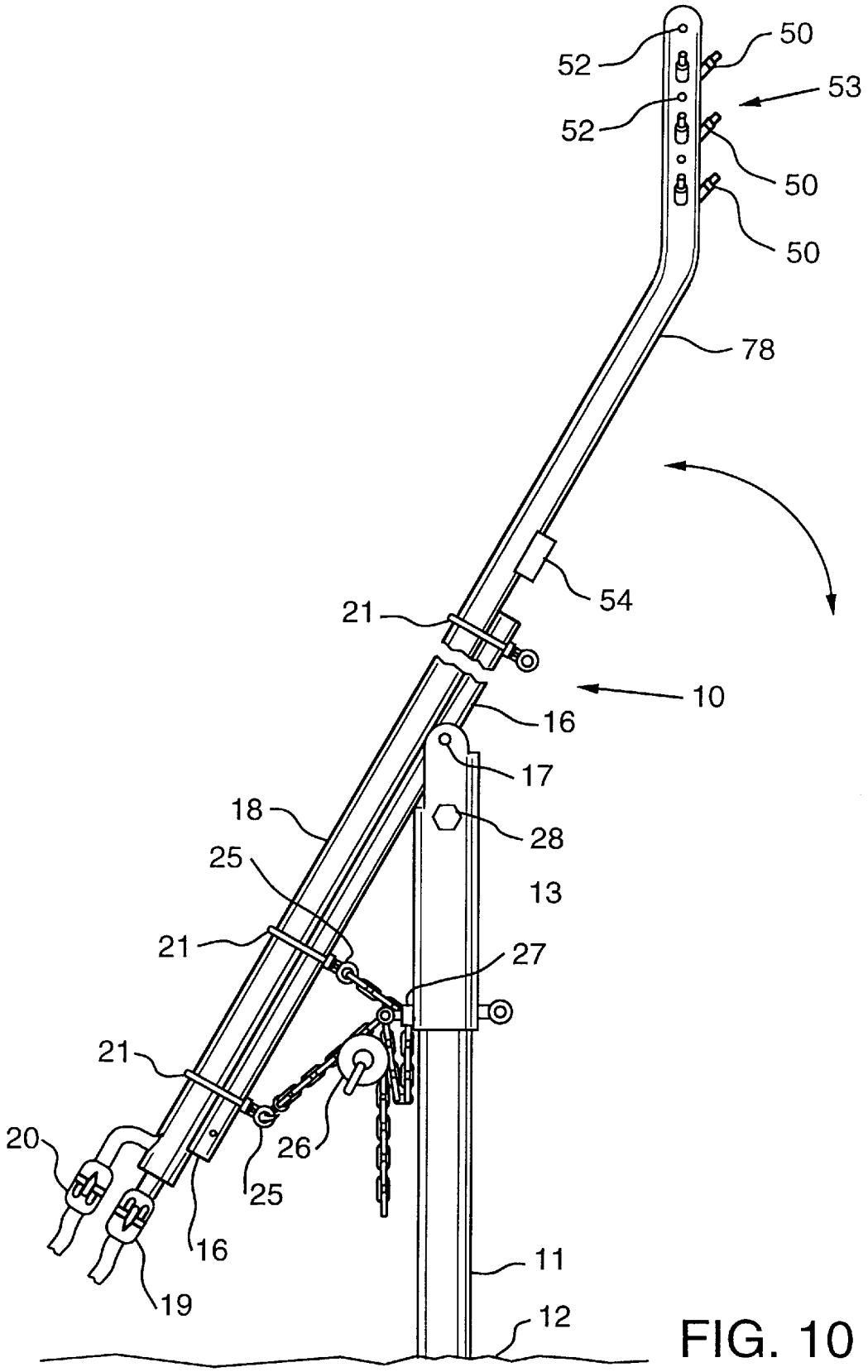
FIG. 10 is a view in side elevation showing another embodiment of the lightweight snow making tower of the present invention.

Referring next to the embodiment shown in FIG. 10, another simplified version of the lightweight snow making tower shown in FIG. 1 is here illustrated. Similar or identical elements are designated with the same reference numerals.

This embodiment is simplified from the structure shown in FIG. 1 by the omission of the support base 14 required in the structure of FIG. 1 and the C-channel 16 instead is directly pivoted intermediate its ends to the top of support pipe 13 at pivot pin 17'. This eliminates a considerable amount of additional required weight.

In substitution of the removable lock 31 in the form of a pin shown in the structure of FIG. 1, in this embodiment removable lock 31 is provided in the form of a chain line that is connected between C-channel 16 in support pipe 13. Of course this chain may be removed or unhooked at both ends when the tension is removed from it by chain hoist 26.

In this particular embodiment, the top of the tower is illustrated and the snow making nozzles 53 include water nozzles 50 and air nozzles 52 for external mixing of air and water under pressure. Of course the present invention is not limited to snow making towers which require external mixing of air and water. The present invention also applies to snow making towers which incorporate some or all aspects of an internal mixing of air and water.

Also, a water drip converter 54 is welded directly to the underside of pipe 18 so that water running down the underside of pipe 18 will run into the diverter 54 and drip off to the ground so that ice will not accumulate on the snow tower structure. This diverter 54 is constructed of a half section of aluminum pipe which is directly welded to the underside of the pipe 18.

I claim:

1. A lightweight snow making tower comprising:

a substantially vertical support pole having a bottom end anchored in a ground surface;

an aluminum support pipe having upper and lower ends and coaxially received on said pole for axial rotation thereon;

an elongated aluminum support arm C-channel having spaced upturned side flanges and pivotally secured intermediate its ends relative to the upper end of said support pipe for rotation in a vertical plane;

an elongated aluminum snow making tower pipe having upper and lower ends with snow making nozzles at the upper end and water and air supply connections at the lower end for connection to sources of water and air under pressure, said tower pipe clamped intermediate its ends on said support arm C-channel with side portions of said tower pipe protruding into said C-channel between said side flanges; and a removable lock for locking said support arm C-channel from pivotal rotation relative to said support pipe at an angle of at least 45° above horizontal.

2. The lightweight snow making tower of claim 1 wherein said elongated aluminum snow making tower pipe is ovular in cross section and said support arm C-channel is provided with saddles therein having contours for mating and seating surfaces of the side portions of said tower pipe which protrude into said C-channel.

3. The lightweight snow making tower of claim 1 wherein said C-channel is pivotally secured directly to the upper end of said pipe.

4. The lightweight snow making tower of claim 3 wherein a stop is comprised of a removable line connected between said C-channel and said support pipe.

5. The lightweight snow making tower of claim 1 including an elongated support base secured to the upper end of said support pipe and said C-channel pivotally secured to an upper end of said support base for providing said rotation in a vertical plane.

6. The lightweight snow making tower of claim 5 wherein said elongated support base is welded at a fixed angle to said aluminum support pipe.

7. The lightweight snow making tower of claim 6 wherein said angle is approximately 60° and an upper end portion of said tower is substantially vertical.

8. The lightweight snow making tower of claim 5 wherein said elongated support base is comprised of an elongated support arm plate secured to the upper end of said support pipe and elongated spaced aluminum angles secured in parallel to each other to an upper surface of said plate with said C-channel positioned in parallel between said angles and pivotally secured to and between respective parallel upwardly projecting flanges of said angles.

9. The lightweight snow making tower of claim 8 wherein said removable lock includes a pin which passes through passages in lower portions in said parallel upwardly projecting flanges and also in said C-channel upturned side flanges.

10. The lightweight snow making tower of claim 1 including securing points between a lower portion of said elongated C-channel and said support pole for securing a hoist mechanism therebetween for pivotally raising said C-channel with said tower pipe clamped thereto.

11. The lightweight snow making tower of claim 1 wherein said elongated aluminum snow making tower pipe is clamped to said support arm C-channel with U-bolts.

12. A lightweight snow making tower comprising:

a substantially vertical support pole having a bottom end anchored in a ground surface;

an aluminum support pipe having upper and lower ends and coaxially received on said support pole for free axial rotation thereon;

an elongated aluminum support arm plate secured to the upper end of said pipe and positioned at an angle of at least 45° above horizontal with a face of said plate facing upwardly;

an elongated aluminum snow making tower pipe having upper and lower ends with snow making nozzles at the upper end and at least a water supply connection at the lower end for connection to a source of water under pressure; and said tower clamped intermediate its ends to said plate on said upwardly facing face.

13. The lightweight snow making tower of claim 12 wherein said elongated support plate is welded at a fixed angle to said aluminum support pole.

14. The lightweight snow making tower of claim 13 wherein said angle is approximately 60° and an upper end portion of said tower is substantially vertical.

15. The lightweight snow making tower of claim 12 wherein said elongated aluminum snow making tower pipe is clamped to said elongated support plate with U-bolts.

* * * * *